US007516623B2

(12) United States Patent
Hall, Sr.

(10) Patent No.: US 7,516,623 B2
(45) Date of Patent: Apr. 14, 2009

(54) CHILLED BEVERAGE DELIVERY SYSTEM

(75) Inventor: Jon D. Hall, Sr., Saginaw, MI (US)

(73) Assignee: Glastender, Inc., Saginaw, MI (US)

( * ) Notice: Subject to any disclaimer, the term of this patent is extended or adjusted under 35 U.S.C. 154(b) by 493 days.

(21) Appl. No.: 11/327,981

(22) Filed: Jan. 9, 2006

(65) Prior Publication Data

US 2007/0157656 A1 Jul. 12, 2007

(51) Int. Cl.
*B67D 5/62* (2006.01)

(52) U.S. Cl. ..... 62/297; 62/298; 62/389; 62/434

(58) Field of Classification Search ..... 62/297, 62/298, 389–400, 430–439
See application file for complete search history.

(56) References Cited

U.S. PATENT DOCUMENTS 2,470,936 A * 5/1949 Lo Gerfo ..... 62/298
2,618,938 A * 11/1952 Booth et al. ..... 62/64
3,228,205 A * 1/1966 Franklin ..... 62/237
4,094,445 A 6/1978 Bevan
4,676,400 A 6/1987 Lamont et al.
4,739,463 A 4/1988 Barna et al.
4,949,552 A 8/1990 Adams
5,685,165 A * 11/1997 Bigelow, Jr. ..... 62/420
5,694,787 A 12/1997 Cleleand et al.
5,743,108 A 4/1998 Cleland
6,101,821 A 8/2000 Cates
6,431,403 B1 8/2002 Davis
6,598,417 B1 7/2003 Wilkes

* cited by examiner

*Primary Examiner*—William E Tapolcai
(74) *Attorney, Agent, or Firm*—John McCulloch; Miller Canfield Paddock & Stone, PLC

(57) ABSTRACT

Apparatus for delivering a chilled beverage from a storage area to a beverage dispenser comprises a beverage conduit, a coolant source or reservoir, a coolant pump, a coolant conduit, an insulating sleeve encircling the conduits and supporting them in positions enabling heat transfer between such conduits, and a common support for the coolant and coolant pump. The common support is so constructed as to enable mounting of the coolant reservoir and pump in any selected one of a number of different locations.

14 Claims, 4 Drawing Sheets

CHILLED BEVERAGE DELIVERY SYSTEM

This invention relates to a system for delivering a beverage from a remote storage area to a dispensing station in such manner as to maintain the beverage at a chilled temperature.

BACKGROUND OF THE INVENTION

It is conventional practice to deliver chilled beer and other beverages in a tavern or other facility from a storage area to a dispensing station at a location remote from the storage area. During the delivery of the beverage from the storage area to the dispensing station the beverage conventionally is maintained at a selected chilled temperature, and such temperature usually is that at which the beverage should be served. Accordingly, it is conventional to provide a system for transporting the beverage from the storage area to the dispensing station under conditions which maintain the beverage temperature at a selected temperature regardless of whether the beverage is stationary in the delivery system, such as when the facility is closed, or actually passing through the system when the facility is open.

Conventional beverage delivery and chilling apparatus incorporates rather elaborate refrigeration and transport systems. A typical transport system has a beverage pump which enables a beverage to be delivered from a source thereof through one or more tubes or lines to the dispensing station. At least part of each beverage delivery tube is formed of thermally conductive material. A coolant is circulated via a pump between a chiller and the dispensing station through coolant tubes which also are at least partly formed of thermally conductive material. The coolant tubes are in contact with or closely adjacent the beverage tubes so that heat transfer between the beverage tubes and the coolant tubes maintains the beverage in a chilled condition.

The chilling system includes a conventional refrigeration apparatus which maintains the coolant at a selected temperature sufficient to effect chilling of the beverage. The refrigeration apparatus conventionally is accommodated in an enclosure mounted at a position which does not interfere with the movement of personnel in the vicinity of the beverage delivery system. To ensure proper operation of the chilling apparatus it should be monitored by both monitoring equipment and personnel. In many instances, however, the chilling system is so located as to be extremely inconvenient to operating personnel who are responsible for the proper operation of the system. In some instances it is both desirable and by the refrigeration enclosure. In other instances, however, it is much more convenient to have the line chilling apparatus remote from the refrigeration enclosure and in a location more accessible to operating or maintenance personnel.

An object of the present invention is to provide beverage line chilling apparatus which is adapted to be supported at any selected one of a number of different locations, thereby enabling such apparatus to be supported at the most convenient position.

SUMMARY OF THE INVENTION

Apparatus constructed in accordance with the invention comprises a system for transporting a beverage from a beverage storage area to a dispensing station and in close association with chilling apparatus by means of which the beverage may be maintained at a selected chilled temperature. The chilling apparatus includes a source of coolant and coolant refrigeration apparatus, as well as a coolant reservoir from which coolant is circulated to and from a beverage dispensing station. The coolant is refrigerated by the refrigeration apparatus and passes from the source of such coolant to the reservoir which includes means for sensing and regulating the temperature of the coolant to enable it to be delivered at a selected temperature to the beverage dispensing station via coolant lines which are parallel and closely adjacent or in engagement with the beverage dispensing lines so as to enable beverages within such lines to be maintained at a selected temperature. From the beverage dispensing station coolant is returned to the coolant source along a coolant return line.

The coolant reservoir, pump, and associated control apparatus are carried by a unitary, common support which is capable of being removably mounted in any selected one of a number of different positions so as to be convenient to and out of the way of operating personnel. The ability of the coolant reservoir and its associated distributing and control apparatus to be supported at any one of a number of possible positions enables the most efficient control of the coolant and the beverage temperature to be maintained.

Apparatus constructed in accordance with the invention is operable with primarily conventional components, thereby avoiding the necessity of providing costly special equipment.

THE DRAWINGS

Apparatus constructed in accordance with the invention is illustrated in the accompanying drawings wherein.

THE PREFERRED EMBODIMENT

Figure 1:
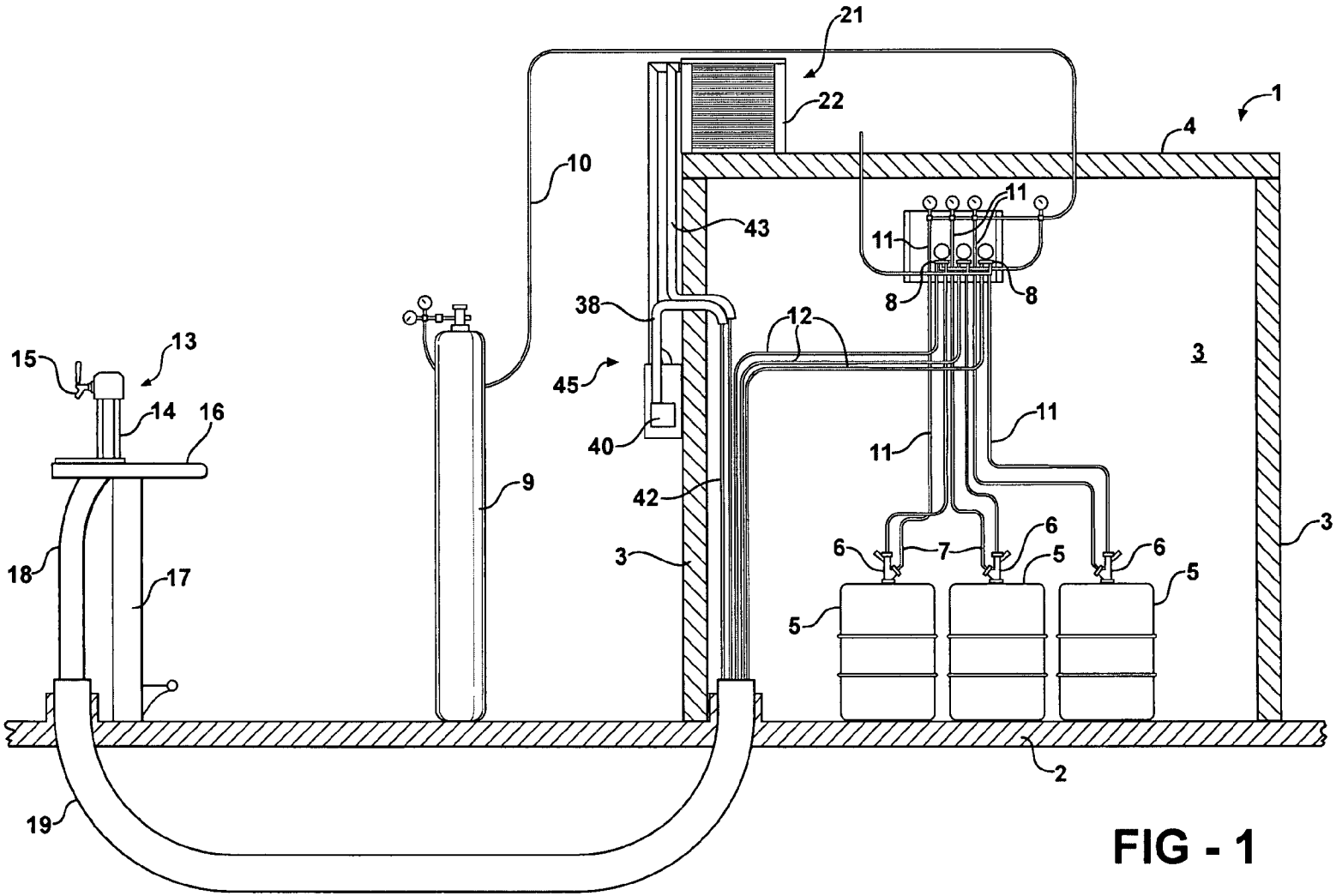
FIG. 1 is a diagrammatic illustration of the beverage delivery and chilling system.
Figure 2:
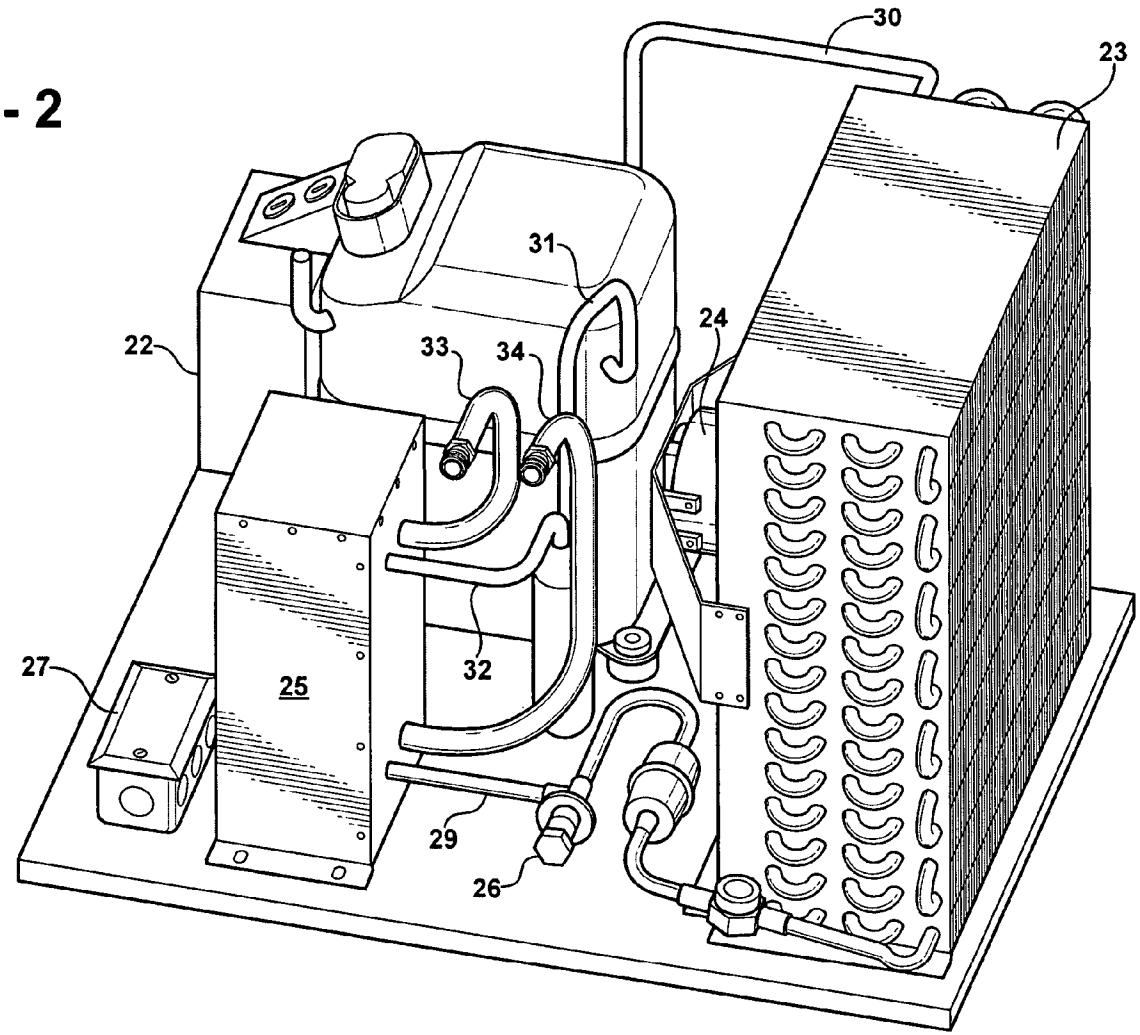
FIG. 2 is an isometric view, on an enlarged scale, of refrigeration apparatus adapted for use in the chilling of a coolant.

Apparatus constructed in accordance with the presently preferred embodiment of the invention is illustrated in FIG. 1 as being associated with an enclosed, walk-in cooler 1 having a floor 2, vertical side walls 3, and a top 4. The cooler 1 is maintained at a selected cool temperature by a cooling mechanism (not shown).

The cooler 1 is adapted to receive one or more beverage containers 5 which, in the disclosed embodiment, are beer kegs. The contents of the several kegs may be the same or different. Each keg constitutes a source of the beverage and has a tap 6 in communication with the interior of the keg so as to enable the beverage to be withdrawn via a line 7and a manifold 8. A tank 9 or other source of compressed gas is coupled via lines 10 and 11 to each of the containers 5. If the gas in the tank 9 is carbon dioxide, it will maintain a head of pressure within each container and also maintain an appropriate degree of carbonation of the beverage.

From the manifold 8 extends a beverage delivery line 12 which traverses the distance from the cooler 1 to a beverage dispensing station 13 comprising a tower 14 having one or more dispensing faucets or spigots 15, there being one faucet for each keg 5. The faucets conventionally are supported at a bar having a horizontal surface 16 atop a vertical support 17.

Extending from the assembly of faucets 15 and encircling the beverage lines 12 is a thermally insulating sleeve 18 which communicates with a thermally insulating sleeve or chase 19 which extends from the dispensing station 13 to the interior of the cooler 1 and through which the beverage delivery lines 12 extend.

The arrangement of the parts of the apparatus thus far described is such that a beverage from any one of the containers 5 may be withdrawn therefrom and delivered via a beverage delivery line 12 to the dispensing station 13 for discharge through a faucet 15. The apparatus thus far described is conventional.

It is desirable to maintain the beverage within the delivery lines 12 at a selected chilled temperature. This may be achieved by refrigeration apparatus comprising an enclosure or housing 21 within which are a compressor 22, a condenser 23, a condenser fan drive motor 24, a coolant tank 25, an expansion valve 26, and an electrical junction box 27 by means of which the various electrical components of the refrigeration apparatus may be connected to a source (not shown) of electrical energy as is conventional.

Two coolant lines 33 and 34 communicate with the tank 25. The line 33 extends through a thermal insulating jacket 35 for connection to an inlet 36 in communication with a coolant reservoir or source 37 (see FIG. 4) so as to deliver chilled coolant to the latter. Also in communication with the coolant reservoir 37 is an outlet line 38 (FIG. 1) within an insulating sleeve or jacket 39 which extends to a pump 40 driven by a motor 41. From the pump 40 extends a jacketed coolant delivery line 42 which leads to the dispensing station 13 via the chase 19 and the jacket 18. From the dispensing station 13 extends a jacketed coolant return line 43 which communicates with the coolant tank 25.

Figure 4:
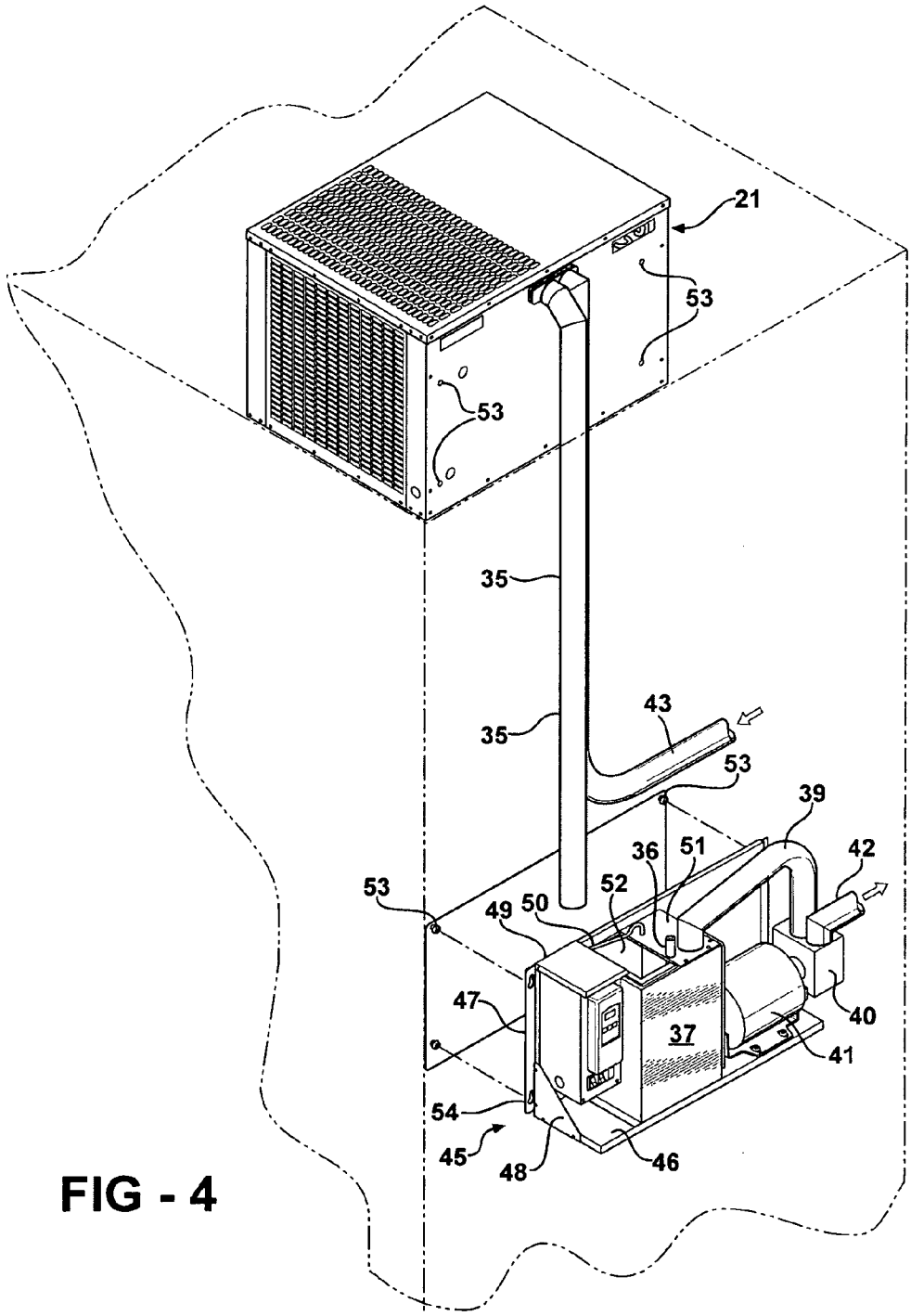
FIG. 4 is a view similar to FIG. 3, but illustrating the line chilling apparatus mounted in a different position.

The coolant reservoir 37, the pump 40, and the pump motor 41 are mounted on a portable, L-shaped, common unitary support 45 comprising a base member 46, an upright attaching member 47, and reinforcing brackets 48 one of which is shown in FIG. 4. Also mounted on the support 45 are a known temperature regulator or controller 49 and a temperature probe 50 which extends from the controller into the interior of the reservoir 37. The controller 49 controls the temperature of the coolant in the tank 25 from which coolant is supplied to the reservoir 37 and responds according to variations in temperature sensed by the probe 50. The reservoir has a top 51 in which is a covered window 52 through which the contents of the reservoir may be viewed.

In the arrangement of parts shown in FIG. 1, the support 45 and the components mounted thereon are removably attached to one vertical wall 3 of the cooler 1. One convenient way of mounting the support 45 on the cooler is by securing first mounting studs 53 to the wall 3 and providing cooperable second mounting means, namely, bayonet slots 54 in the support upright 47 for the removable accommodation of the studs 53. This, however, is not the only way in which the support 45 may be removably mounted on a supporting structure. Any other separable mounting means may be used to mount the support 45 removably on the wall.

Figure 3:
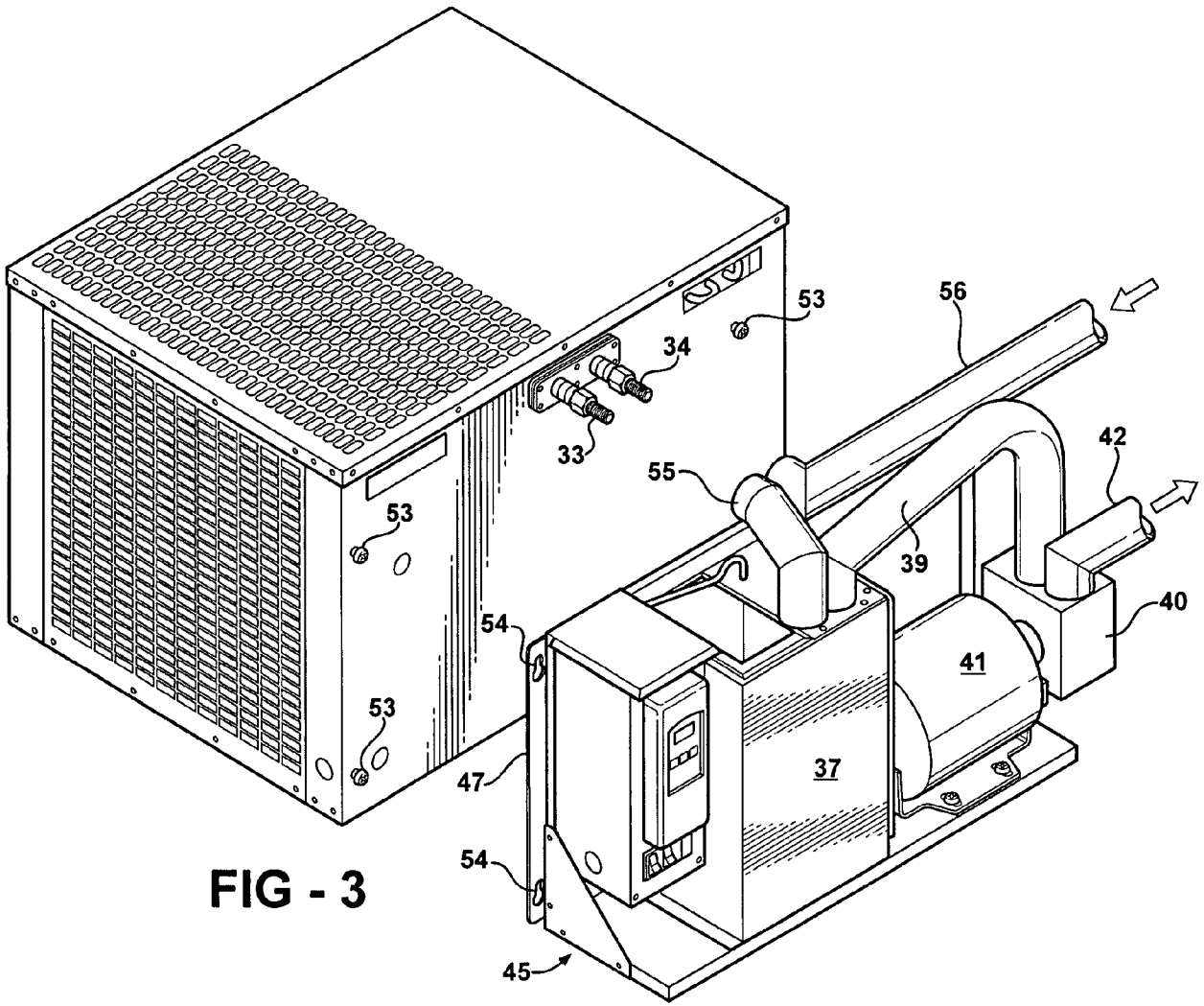
FIG. 3 is an exploded, isometric view of the refrigeration apparatus and beverage line chilling apparatus in condition to be mounted in one position.

Mounting of the support on a wall of the cooler is only one position in which the support may be mounted. As is shown in FIG. 3, the support 45 is mounted in a second, remote position on one side of the refrigeration enclosure 21 by a second set of studs 53 and which removably may be accommodated in the bayonet slots 54 of the upright attaching member 47. Depending on the location in which the support 45 is mounted, and the distance between the support and the coolant tank 25, the coolant lines 35 and 43 may be adjusted in length. In FIG. 3, a shorter coolant line 55 replaces the coolant line 35 and a shorter coolant line 56 replaces the coolant line 43. It will be understood that, although the reference characters 35, 43, 55, and 56 have been used to designate coolant lines, the actual coolant lines may be within the tubes 35, 43, 55, and 56 which are insulating jackets.

The arrangement is such that the support 45 and the parts supported thereon may be mounted in any selected one of virtually an unlimited number of locations so as to enable the components mounted on the support to be accessed conveniently.

By locating the support 45 and the parts supported thereon in a position convenient to operating personnel, the presence of and the flow of coolant to and from the coolant reservoir 37 may be monitored visually and manually, the temperature of the coolant in the tank may be monitored automatically or manually by adjusting the temperature control 49, and the speed of the motor 41 may be adjusted manually or automatically in known manner as may be required. The ability to locate the support 45 and its component parts at any selected one of a number of positions thus enables such parts to be located at the most convenient and accessible position.

The disclosed embodiment is representative of a presently preferred form of the invention, but is intended to be illustrative rather than definitive thereof. The invention is defined in the claims.

I claim:

1. Beverage delivery and cooling apparatus comprising a beverage source; beverage dispenser means; beverage conduit means for delivering said beverage from said beverage source to said dispenser means; chilled coolant reservoir means; chilled coolant conduit means for circulating chilled coolant between said chilled coolant reservoir means and said dispenser means; pump means for pumping said coolant through said chilled coolant conduit means; portable support means supporting said chilled coolant reservoir means and said pump means, said support means being movable from a first position to any selected one of a plurality of other positions; first mounting means at each of said positions; and second mounting means carried by said common support and being cooperable with said first mounting means at each of said positions for separably mounting said common support means at any selected one of said positions.

2. The apparatus according to claim 1 including insulating means comprising a sleeve of thermal insulating material encircling said beverage conduit means and said coolant conduit means between said coolant reservoir means and said dispenser means.

3. The apparatus according to claim 2 wherein the beverage conduit means and the coolant conduit means comprise tubes closely adjacent one another within said sleeve.

4. The apparatus according to claim 1 wherein said first and second mounting means are attachable to and detachable from each other.

5. The apparatus according to claim 4 wherein said first and second mounting means comprise cooperable studs and stud-accommodating slots.

6. The apparatus according to claim 5 wherein said slots are in said common support.

7. The apparatus according to claim 6 wherein said slots are bayonet slots.

8. In a chilled beverage delivery system having a beverage source, a beverage dispenser, beverage conduit means for delivering said beverage from said beverage source to said dispenser, chilled coolant reservoir means; chilled coolant conduit means for circulating chilled coolant between said reservoir means and said dispenser, pump means for pumping said coolant through said chilled coolant conduit means, and support means for supporting said reservoir means and said pump means, the improvement wherein said support means is portable and movable with said reservoir means and said pump means from a first position to at least one other position remote from said first position; first mounting means carried by said support means; and second mounting means at said first position and at said other position for mounting said common support at a selected one of said positions.

9. The system according to claim 8 wherein the beverage conduit means comprises at least one tube and wherein the coolant conduit means comprises at least one tube, each of said tubes being formed of thermally transmitting material, said tubes being in engagement with each other to enable heat transfer between said tubes.

10. The system according to claim 9 including a plurality of said beverage tubes, and a corresponding plurality of said dispensers coupled to said beverage tubes.

11. The system according to claim 8 wherein said common support means comprises a base member on which said coolant reservoir means and said pump means are supported, and an attaching member joined to said base member for separable attachment to the second mounting means at any of said positions.

12. The system according to claim 8 wherein said mounting means comprises bayonet slots removably accommodating studs.

13. The system according to claim 12 wherein said slots are in said attaching member.

14. Beverage delivery apparatus comprising a beverage source; a beverage dispenser; beverage conduit means for delivering said beverage from said beverage source to said dispenser means; chilled coolant reservoir means; chilled coolant conduit means for circulating chilled coolant between said reservoir means and said dispenser means; pump means for circulating chilled coolant through said conduit means; portable common support means supporting said reservoir means and said pump means, said common support means being movable from any one of a plurality of different positions to any other one of said plurality of positions; first mounting means at each of said positions; and second mounting means carried by said common support means and being cooperable with each of said first mounting means for separably mounting said common support means at any selected one of said plurality of positions.

* * * * *